US012108862B1

(12) United States Patent
Neugent

(10) Patent No.: US 12,108,862 B1
(45) Date of Patent: Oct. 8, 2024

(54) FLUID DISPENSER

(71) Applicant: Sabrina S Neugent, Midlothian, TX (US)

(72) Inventor: Sabrina S Neugent, Midlothian, TX (US)

( * ) Notice: Subject to any disclaimer, the term of this patent is extended or adjusted under 35 U.S.C. 154(b) by 0 days.

(21) Appl. No.: 18/235,387

(22) Filed: Aug. 18, 2023

Related U.S. Application Data

(60) Provisional application No. 63/398,886, filed on Aug. 18, 2022.

(51) Int. Cl.
*A45D 34/04* (2006.01)
*A45D 40/26* (2006.01)
*A46B 11/00* (2006.01)

(52) U.S. Cl.
CPC ..... *A45D 34/042* (2013.01); *A45D 40/262* (2013.01); *A46B 11/0041* (2013.01)

(58) Field of Classification Search
CPC ... A46B 11/00; A46B 11/002; A46B 11/0041; A46B 11/0044; A45D 34/042; A45D 40/262
USPC ..... 401/183–186, 268; 383/50, 55, 906; 206/229
See application file for complete search history.

(56) References Cited

U.S. PATENT DOCUMENTS 3,292,644 A * 12/1966 Ericson ..... A46B 11/0041 401/132
4,974,984 A * 12/1990 Kafkis ..... A45D 34/042 401/268
5,911,532 A * 6/1999 Evancic ..... A46B 11/002 401/281
6,883,993 B2 * 4/2005 Malki ..... A46B 5/0075 401/281

* cited by examiner

*Primary Examiner* — David J Walczak
(74) *Attorney, Agent, or Firm* — Jeffrey Roddy

(57) ABSTRACT

A fluid dispenser article includes an exterior, a fluid reservoir, a foldable brush/applicator portion, a movable flap which covers the brush/applicator portion, and a conduit between the reservoir and the brush/applicator portion such that fluid may flow up to the brush tip when the reservoir is squeezed.

4 Claims, 4 Drawing Sheets

FLUID DISPENSER

The invention relates to fluid dispensers and particularly cosmetic applicators.

BACKGROUND

Lipsticks and lip gloss typically are provided by cosmetic manufacturers in stick (solid) or liquid form (bottled) with a separate applicator, typically a brush, whether foam or bristle. As quality cosmetics can be expensive, collecting any more than a trivial number of shades may be cost prohibitive. Additionally, conventional lipstick packaging often requires special storage considerations, e.g., upright storage and in a cool dark location. Furthermore, containers of lipstick may over time separate into a solution or become contaminated; e.g., with bacteria or fungi.

Accordingly, it would be desirable to provide consumers with a special container having a small convenient amount of lipstick so that they may collect and try a variety of shades without committing to a large quantity of product. It would be further desirable if the special container included a lipstick applicator portion integrated with the packaging. It would be even further desirable if the special container were resealable.

SUMMARY

In a general example implementation of the present invention, a fluid dispenser includes a container with a fold-away applicator adapted to dispense fluids from a reservoir of the dispenser.

In an aspect combinable with any other aspect described herein, the reservoir is compressible.

In an aspect combinable with any other aspect described herein, in some implementations the reservoir may be formed between one or more sheets, films or webs of the container.

In an aspect combinable with any other aspect described herein, in some implementations, the reservoir may be formed between one or more sheets, films or webs separate from the container.

In an aspect combinable with any other aspect described herein, the brush/applicator may be a natural or synthetic bristle brush.

In an aspect combinable with any other aspect described herein, fluid is transferred to the brush/applicator via a conduit that channels the fluid from the reservoir to the brush when the reservoir is compressed.

In an aspect combinable with any other aspect described herein, the container is disposable after a number of uses.

In an aspect combinable with any other aspect described herein, in some implementations the brush/applicator is reversibly foldable both toward the reservoir and away from the reservoir.

In an aspect combinable with any other aspect described herein, in some implementations the brush/applicator may be collapsible in an accordian fashion and may be extended therefrom.

In an aspect combinable with any other aspect described herein, in some implementations, the brush/applicator is accessible by folding or peeling away a protective cover or flap.

In an aspect combinable with any other aspect described herein, in some implementations an application end of the brush/applicator may have a convex shape, a planar shape, a beveled shape or a curved shape.

In an aspect combinable with any other aspect described herein, the viscosity of the fluid held in the reservoir may vary and the fluid may be dispensed from any position.

It should be understood that the features, objects and aspects of any one embodiment may be added to or combined with the features, objects or aspects of any other embodiment.

BRIEF DESCRIPTION OF THE DRAWING FIGURES

REFERENCE TO THE NUMBERED ELEMENTS

Figure 1:
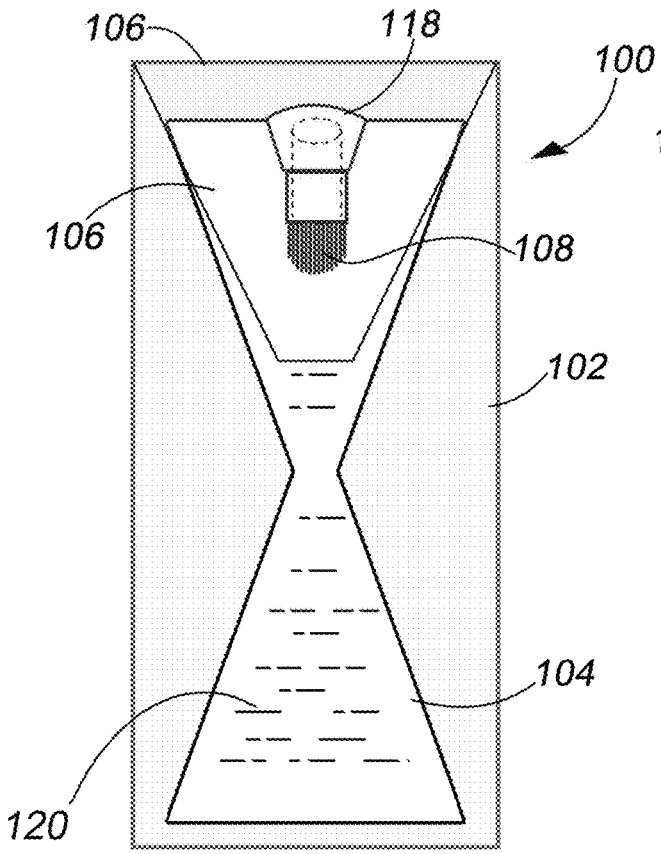
FIG. 1 shows a front view elevation of a fluid dispenser.

100 fluid dispenser
102 exterior
104 fluid reservoir
106 flap
108 brush/applicator portion
109 bristles/foam
112 separation
118 conduit
119 connector
120 fluid/makeup

Definitions

In the following description, the term "fluid" typically refers to a fluid intended for application to a human body which may vary in viscosity from a liquid to a gel or paste. The term "lipstick" may mean a cosmetic, a balm, an antibiotic or any substance applicable to human lips. The term "reservoir" means any pouch, pocket or compartment adapted to hold a quantity of fluid. The term "conduit" refers to a physical feature that conveys fluid contained in the reservoir to the brush/applicator tip. The brush/applicator tip may include a bristles or permeable foam. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

Referring generally to FIGS. 1-9, a fluid dispenser article (100) includes an exterior (102) a fluid reservoir (104) a foldable brush/applicator portion (108), a movable flap (106) which covers the brush/applicator portion (108), and a conduit (118) between the reservoir (104) and the brush/applicator portion such that fluid may flow up to the brush tip when the reservoir is squeezed.

Mode of Operation

In order to use the article, flap (106) is peeled away from the article (100) providing access to the foldable brush/applicator (108) portion which is connected to the reservoir (104) by conduit (118) which also is foldable and may reside partially inside the foldable brush/applicator portion (108). The brush/applicator portion is folded away from the reservoir (104) such that it may extend from the dispenser and assume a position ready to dispense fluid to the lips. Once the brush/applicator is thus positioned, the reservoir may be squeezed to push the fluid through the conduit (118) and to the applicator. Flap may be attached to the exterior of the dispenser by adhesive, or formed integrally with the dispenser and separable via perforations forming a separation line (112) that provides access to the foldable brush/applicator. Furthermore in some implementations, the flap may be connected to the applicator portion such that when the flap is moved away from the reservoir it may actuate the applicator portion to assume an upright ready-to-dispense position.

FIG. 1 is a front view elevation of a fluid dispenser. It should be understood that the hour-glass shape of the fluid reservoir (104) is merely exemplary, and persons having ordinary skill in the art and access to this disclosure will appreciate that other shapes, e.g., oval, rectangular, triangular, circular, etc., may be suitable. Typically, the reservoir may be formed integrally with the exterior (102); for example, the dispenser may produced in a web wherein spaces around the reservoir are heat sealed front to back, and the brush/applicator portion (108) and conduit (118) are sonically welded to the reservoir prior to filling of same. Persons having skill in the art and familiar with web laminated and print web processes will understand a variety of common manufacturing processes may be employed to produce the disclosed invention. Alternately, the reservoir may be produced and filled in a first process and then in a second process laminated between a sandwich of material including exterior (102).

Figure 2:
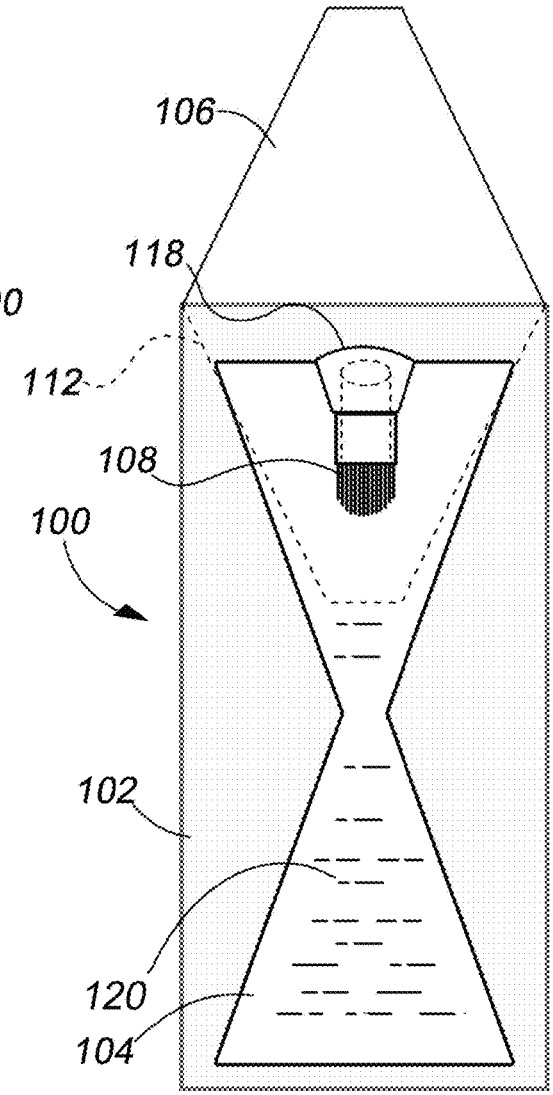
FIG. 2 is a front side view thereof showing flap folded away from the front of the dispenser.
Figure 3:
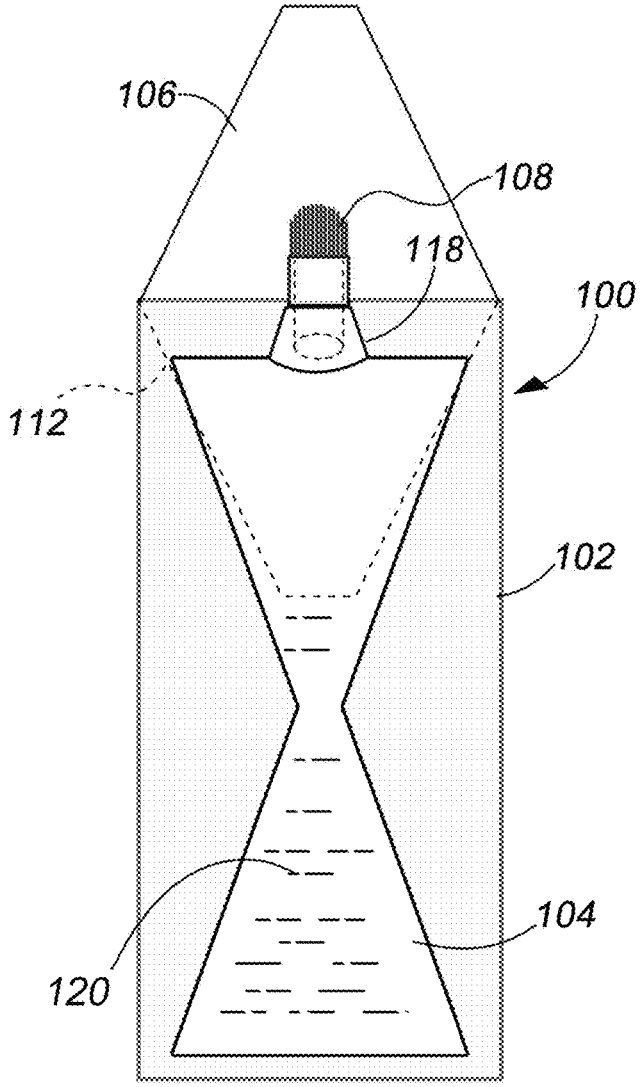
FIG. 3 is a front side view showing brush/applicator folded away from the interior compartment.

FIG. 2 shows the dispenser (100) with flap (106) peeled away from the dispenser body exposing the brush/applicator portion (108). In FIG. 3 the brush/applicator (108) is shown in an extended position. Conduit (118) may include a channel shown in dashed line that connects the brush to the fluid reservoir. Conduit (118) may be made of a flexible plastic such as LDPE, while the remainder of the dispenser may be made of laminated foil lined mylar or any one of a variety of suitable materials used to contain cosmetics and related fluids.

Figure 4:
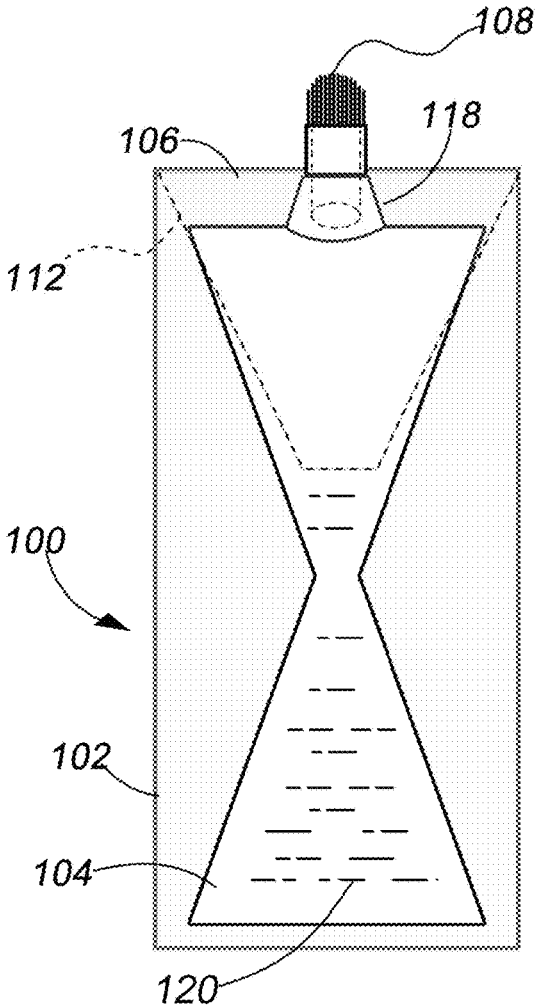
FIG. 4 is a front side view thereof showing flap folded away from the extended brush/applicator.

FIG. 4 shows flap (106) moved to the back side of the dispenser (100) to assist in applying the lipstick.

Figure 5:
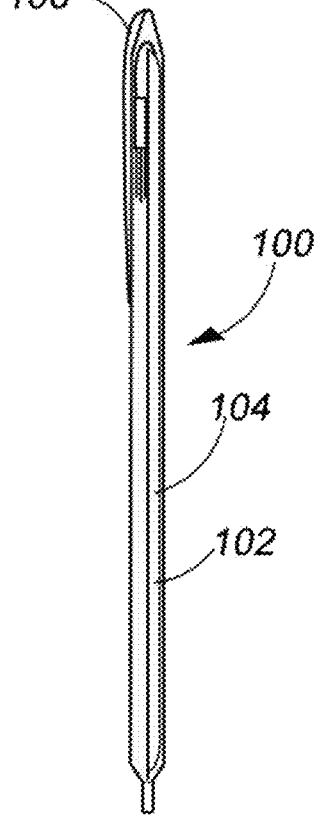
FIG. 5 is a right side view of the fluid dispenser shown with flap closed.
Figure 6:
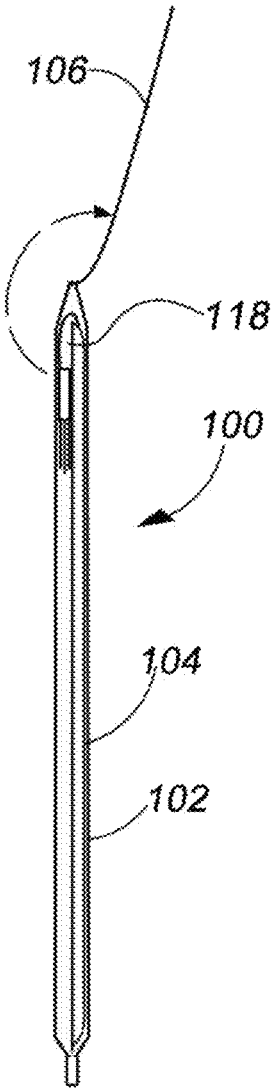
FIG. 6 is a right side view shown with the flap folded away from the front of the dispenser.
Figure 7:
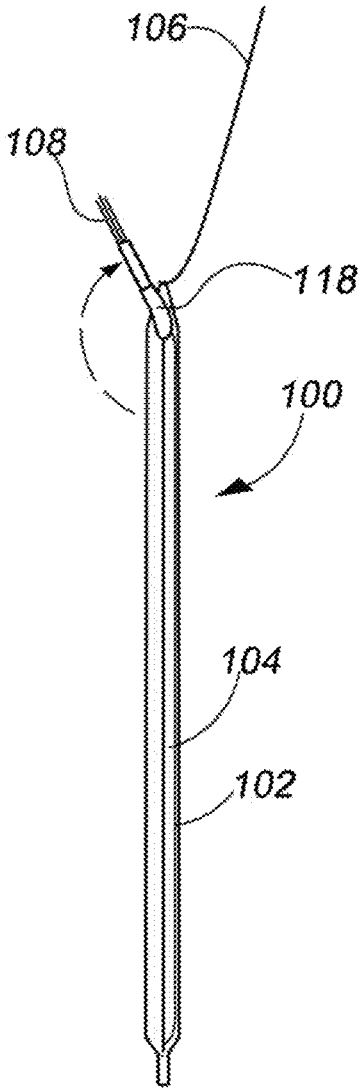
FIG. 7 is a right side view shown with the brush/applicator folded away from the interior compartment.

FIGS. 5-7 are sequential side views of the dispenser showing it in a closed position (FIG. 5), flap up position (FIG. 6) and brush/applicator portion (108) extended (FIG. 7).

Figure 8:
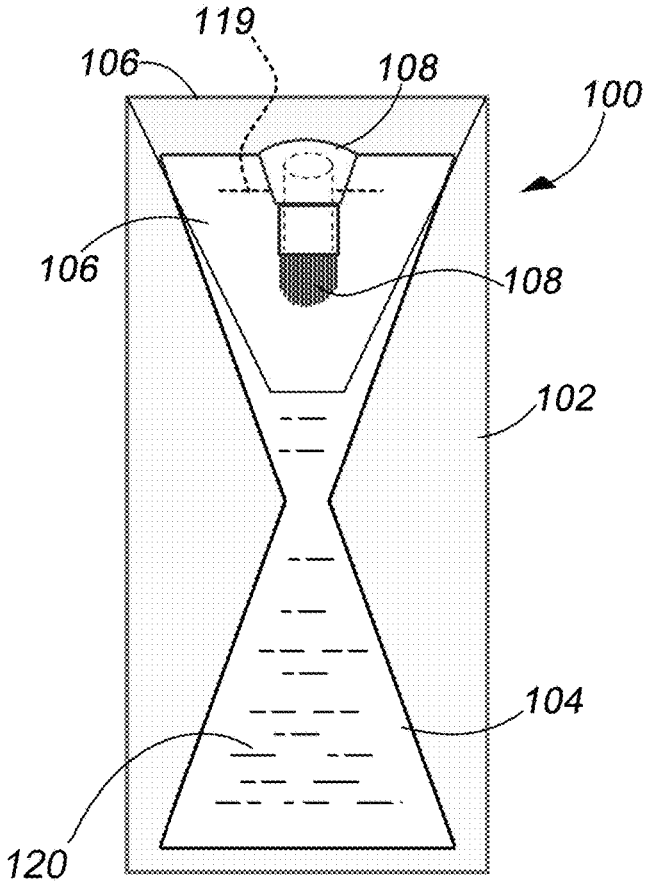
FIG. 8 is a front side elevation showing a dispenser in a closed position.
Figure 9:
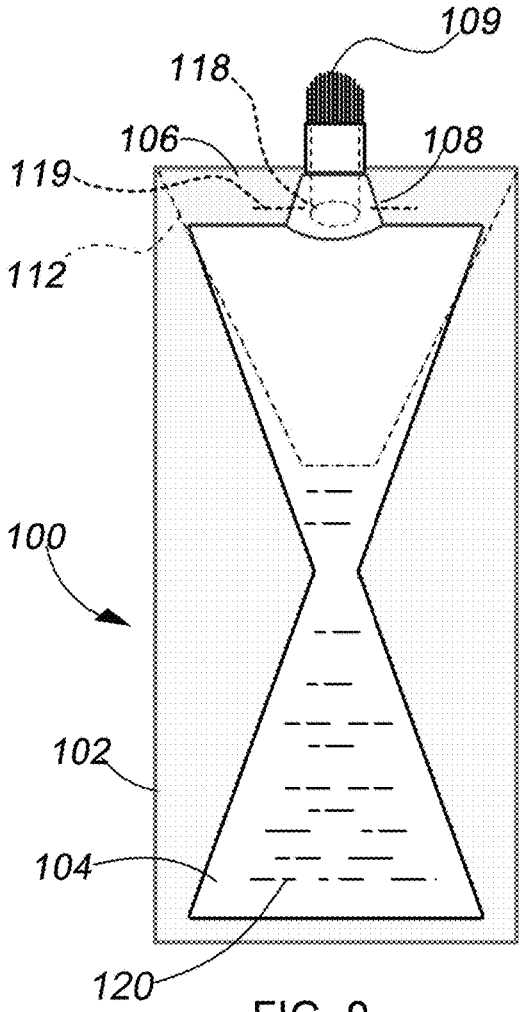
FIG. 9 is another side elevation showing the dispenser in an open position.

FIGS. 8 and 9 respectively show the dispenser in a closed and open position and wherein flap (106) is connected to the applicator portion (108) such that moving the flap back pulls the applicator into an upright position. This feature may be accomplished by a small material connector such as a thin strip of LDPE connected (119) to an upper section of the applicator portion (108) for example, just below where the bristles or foam are joined to the applicator.

It should be understood that the drawings and detailed description herein are to be regarded in an illustrative rather than a restrictive manner, and are not intended to be limiting to the particular forms and examples disclosed. For example, in addition to cosmetics application, various implementations described herein may be suitable for the dispensing of medicaments, paints, inks and other solutions. Accordingly, it is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

I claim:

1. A dispenser article for a cosmetic solution comprising:

an article including an exterior surface and a compressible interior reservoir adapted to contain the cosmetic solution;

a cosmetic applicator portion connected to the reservoir via a conduit, the conduit is adapted to form a channel for the cosmetic solution, the cosmetic applicator portion includes a brush or permeable foam construction, and is movable from a folded position to an extended position;

a flap connected to a section of the cosmetic applicator portion adapted to movably actuate the cosmetic application portion from the folded position to the extended position by movement of the flap.

2. The dispenser article according to claim 1, a distal end of the conduit adapted to express the cosmetic solution.

3. The dispenser article according to claim 1, the exterior including a front side and a back side and the interior reservoir disposed therebetween.

4. The dispenser article according to claim 1, the applicator portion connected to the flap.

* * * * *